US005505559A

United States Patent [19]

Hermansen

[11] Patent Number: 5,505,559

[45] Date of Patent: Apr. 9, 1996

[54] SAFETY VALVE FOR BOUYANCY COMPENSATOR

[75] Inventor: Frank Hermansen, Costa Mesa, Calif.

[73] Assignee: QDS Enterprises, Inc., Vista, Calif.

[21] Appl. No.: 287,201

[22] Filed: Aug. 8, 1994

[51] Int. Cl.[6] ..... B63C 11/02

[52] U.S. Cl. ..... 405/186; 137/505.11; 441/106

[58] Field of Search ..... 405/186, 185; 441/92, 96, 106; 114/315; 137/505.11, 605, 888, 522

[56] References Cited

U.S. PATENT DOCUMENTS

| | | | |
|---|---|---|---|
| 4,114,389 | 9/1978 | Bohmrich et al. | 405/186 |
| 4,137,585 | 2/1979 | Wright, III . | |
| 4,324,507 | 4/1982 | Harrah | 405/186 |
| 4,379,656 | 4/1983 | Darling | 137/505.11 X |
| 4,437,790 | 3/1984 | Trop | 405/186 |
| 4,529,333 | 7/1985 | Robinette | 405/186 |
| 4,720,281 | 1/1988 | Matsuoka | 441/92 |
| 4,986,700 | 1/1991 | Takeda | 405/186 |

*Primary Examiner*—Dennis L. Taylor

*Attorney, Agent, or Firm*—Brown, Martin, Haller & McClain

[57] ABSTRACT

A safety valve for a buoyancy compensator has an inlet for connection to one end of an inflation hose for supplying gas to the buoyancy compensator, an outlet for connection to a gas inlet of the buoyancy compensator, and a passageway connecting the inlet to the outlet. A vent chamber has an orifice communicating with the passageway for allowing gas to vent through the orifice and out via vent outlets in the chamber. A valve member is pivotally mounted in the chamber for movement between a position closing the orifice and a pivoted position at an angle to the orifice. A pull cable extending through the inflation hose is directly coupled to the valve member so that pulling on the pull cable will tilt the valve member into the pivoted, open position.

10 Claims, 3 Drawing Sheets

SAFETY VALVE FOR BOUYANCY COMPENSATOR

BACKGROUND OF THE INVENTION

The present invention relates generally to buoyancy compensators for use by divers in adjusting buoyancy, in which an inflatable vest or jacket is worn by the diver and air is let in or out of the jacket to adjust buoyancy, and is particularly concerned with a safety or pressure relief valve for such a buoyancy compensator.

Buoyancy compensators are typically equipped with power inflators for fine control of the amount of air filling the compensator, as well as safety valves which open automatically if an excessive amount of air fills the inflatable vest or jacket. Such safety valves typically incorporate a manual device allowing the diver to open the valve and exhaust air from the vest or jacket as desired. The safety valve or pressure relief valve normally has a valve member biassed by a spring or the like into a closed position and open to pressure within the inflatable jacket. When pressure in the jacket is sufficient to overcome the spring biassing force, the valve member is urged into an open position allowing exhaust of gas from the jacket. A manually operable mechanism is provided for allowing the diver to pull the valve member manually into an open position for rapid buoyancy change. Some safety valves are completely separate from the power inflator system, while others are incorporated into the power inflation system. In the latter case, the valve operating mechanism is typically quite complex.

SUMMARY OF THE INVENTION

It is an object of the present invention to provide a new and improved safety valve for a buoyancy compensator.

According to the present invention, a safety valve for a buoyancy compensator is provided, which comprises a valve housing having an inlet for coupling to one end of an expandable inflation hose, an outlet for coupling to an air inlet of a buoyancy compensator, and an internal passageway connecting the inlet to the outlet, the housing also having a vent chamber with at least one vent outlet, and an orifice connecting the vent chamber to the passageway for venting gas from the buoyancy compensator, a valve seat in the vent chamber surrounding the orifice, and a valve member movably mounted in the vent chamber and biassed into a first position in seating engagement with the valve seat to close the orifice, the valve member being exposed to pressure within the compensator via the orifice in the first position, whereby when the pressure is sufficient to overcome the biassing force, the valve member is urged into a second, open position to allow gas to vent from the compensator via the vent chamber and vent outlet. The valve member is pivotally mounted on the valve seat to allow tilting of the valve member about a pivot axis from the first position into a third position in which the orifice is also open, and has a stem extending through the orifice into the passageway. A pull cable for manually operating the valve has a first end secured to the stem and extends out of the housing through the inlet for extension through an inflation hose coupled to the inlet and into a power inflator connected to the opposite end of the inflation hose so that the second end of the pull cable can be secured to the power inflator. Pulling on the second end of the pull cable will tilt the valve member into the third, open position so that the safety valve can be opened manually as necessary.

With this arrangement, in which the valve member can slide axially or tilt in order to open the valve, a complicated linkage mechanism between the pull cable and valve member is not needed and the pull cable can be simply secured directly to the valve stem. Jamming or improper operation of the valve is therefore less likely to occur.

In a preferred embodiment of the invention, the valve member comprises a flat disc having a downwardly depending stem of reduced diameter, the disc having an opening positioned on one side of the orifice. A pivot pin projects upwardly from a lower wall of the vent chamber and the disc opening engages slidably over the pivot pin so that the disc can move axially up and down between the first and second positions. The pull cable is secured to the stem. The valve member or disc engages over the pivot pin with some free play for allowing the disc to pivot or tilt about the axis of the pivot pin into the third, open position when the pull cable is pulled in a direction away from the pivot pin to urge the stem to tilt.

Thus, the valve member will open automatically if the pressure in the compensator exceeds a predetermined safety level. Additionally, the valve member can be opened manually simply by the diver pulling on the pull cable, or on the power inflator to which the pull cable is secured. The valve is therefore quick and easy to operate, and has a minimum of moving parts, reducing both expense and the liability of failure.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
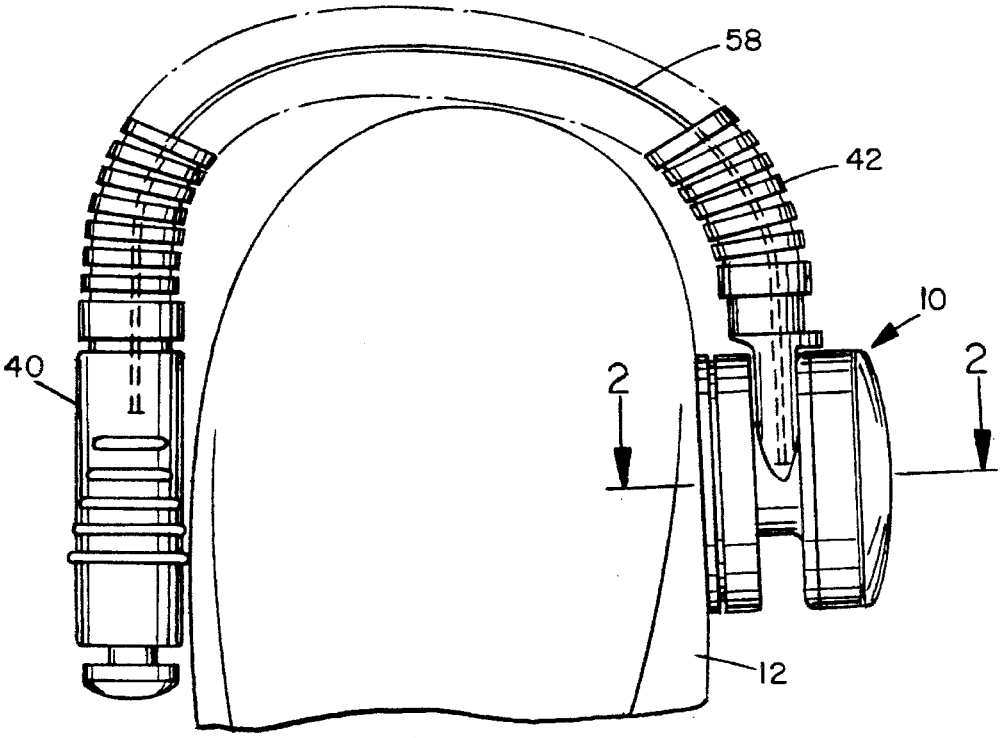
FIG. 1 illustrates the valve assembly according to a preferred embodiment of the invention mounted on a jacket.
Figure 2:
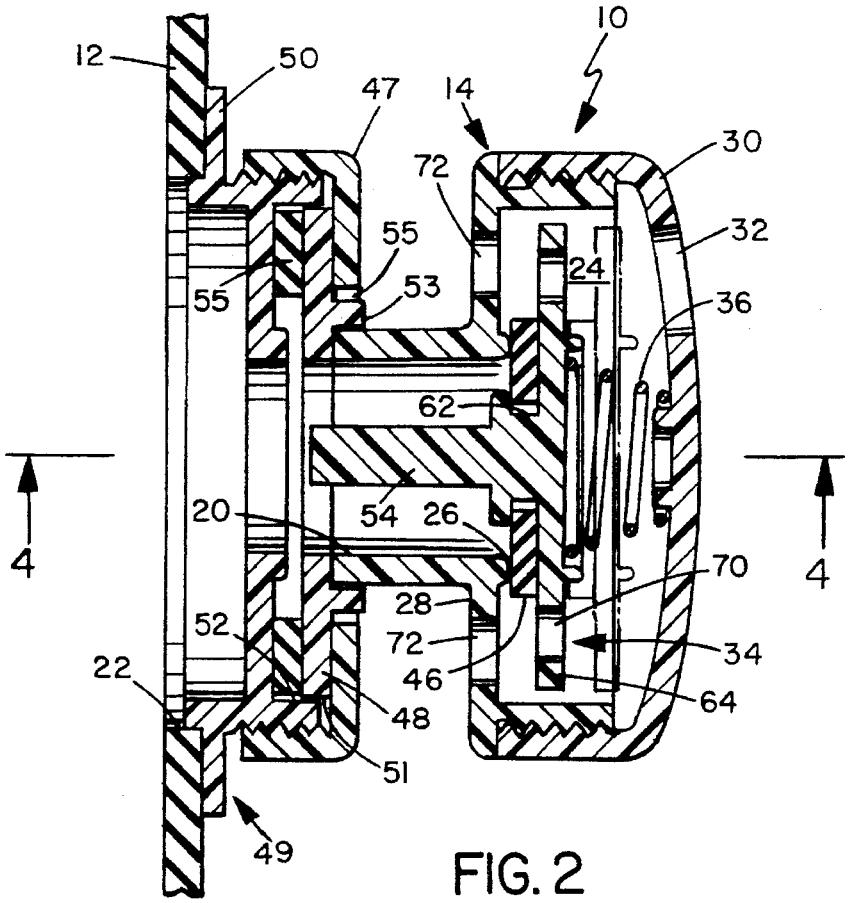
FIG. 2 is an enlarged sectional view taken on line 2—2 of FIG. 1.
Figure 3:
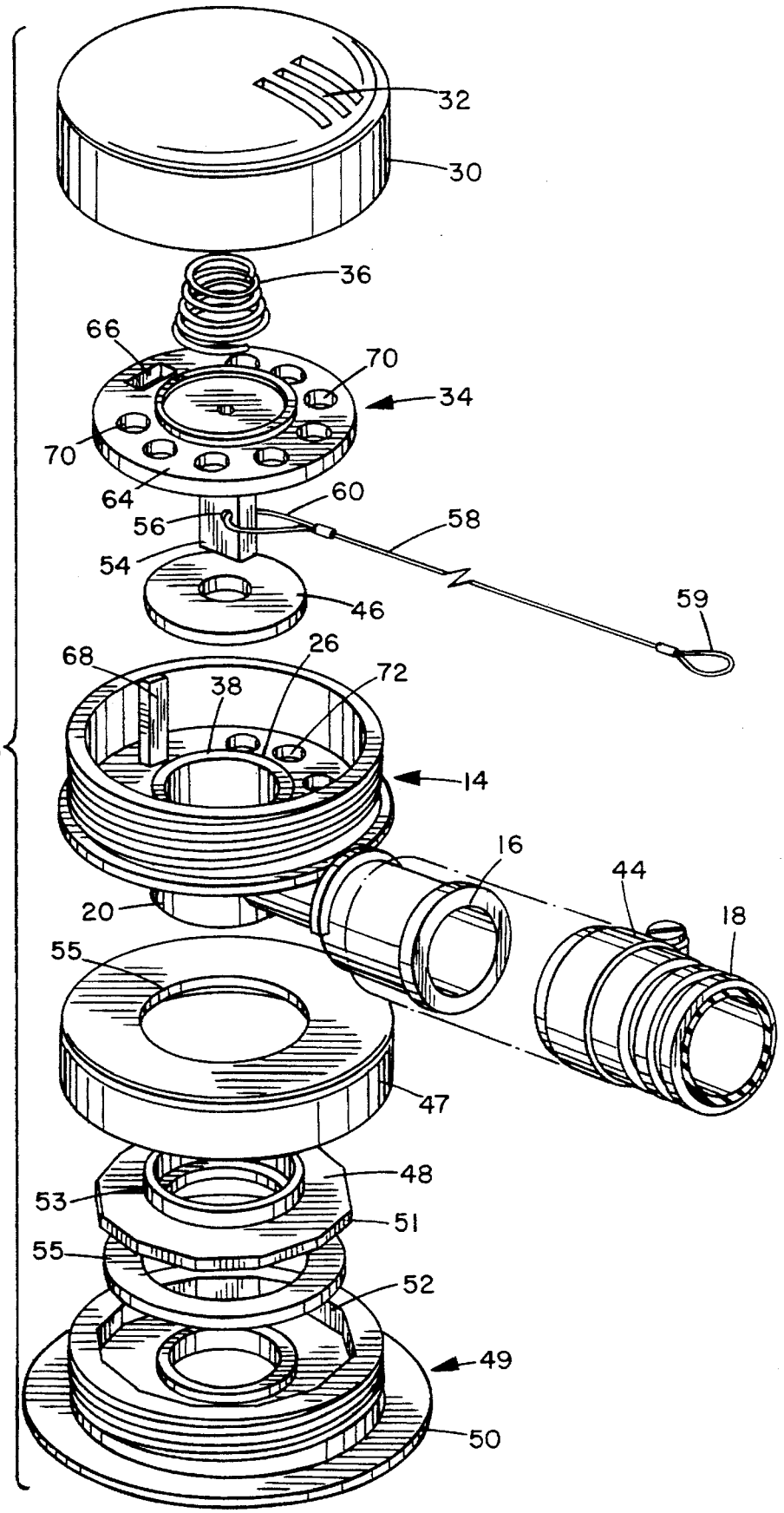
FIG. 3 is an exploded view of the valve components.
Figure 4:
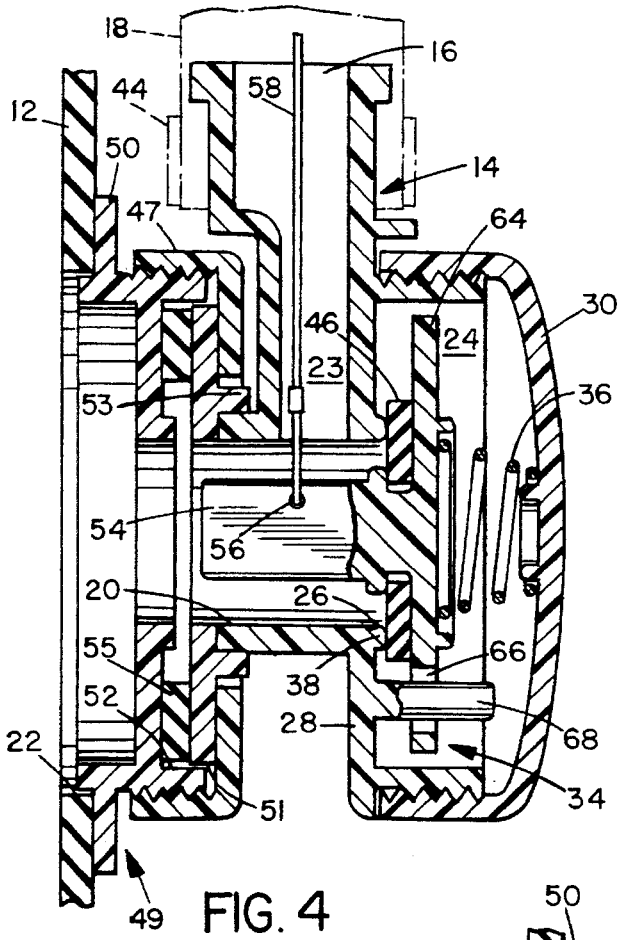
FIG. 4 is a sectional view taken on line 4—4 of FIG. 2.

FIG. 1 of the drawings illustrates a safety valve 10 according to a preferred embodiment of the present invention installed on an inflatable bladder 12 in the form of a jacket or vest for use as a diving buoyancy compensator, while FIGS. 2–5 illustrated the safety valve in more detail. The safety valve 10 basically comprises a housing 14 having an inlet 16 for connection to one end of an inflation hose 18 and an outlet 20 communicating with an air inlet 22 of the bladder 12 over which the safety valve 10 is mounted, as best illustrated in FIGS. 3 and 4. An internal passageway 23 connects the inlet 16 to the outlet 20. A vent chamber 24 in the housing 14 is located directly over outlet 20 and communicates with passageway 23 via orifice 26 in the lower wall 28 of the chamber 24. The vent chamber has an open upper end partially closed by a removable vent cap 30 which has one or more vent outlets 32 for permitting air flow out of the vent chamber 24. A valve member or disc 34 is mounted in the chamber 24 and is normally biassed by spring 36 into sealing engagement with a valve seat 38 surrounding orifice 26.

The opposite end of inflation hose 18 is connected to a power inflator 40 for fine control of air flow into and out of the compensator. The power inflator 40 is also connected to a pressurized air tank (not illustrated) via high pressure hose. The power inflator may be a conventional power inflator as is typically used on diving buoyancy compensators, but is preferably a power inflator as described in my co-pending application filed on even date herewith, entitled "Power Inflator Assembly for Buoyancy Compensator," the contents of which are incorporated herein by reference.

The components of the safety valve 10 are illustrated in more detail in the exploded view of FIG. 2. The components basically comprise the housing 14 to which an end of inflation hose 18 is secured via cable tie 44 or the like, valve 34, spring 36, vent cap 30, a disc-shaped seal member 46 for seating between valve member 34 and the valve seat 38, a manifold cap 47, and an annular flange member 48. The manifold cap 47 and the annular flange member 48 couple the housing to the manifold 49 secured in the air inlet of buoyancy compensator air inlet 22, as best illustrated in FIGS. 2 and 3. Manifold 49 is of conventional design and has an annular flange 50 bonded or welded to the outer surface of the compensator around air opening 22 provided in the compensator material, and a cylindrical portion projecting outwardly from opening 22. Annular flange member 48 has a flange with a dodecagonal outer periphery 51 for fitting in a corresponding dodecagonal bore 52 in manifold 49 over annular seal member or washer 55, and a central ring portion 53 which is welded to housing outlet 20, capturing cap 47 over ring portion 53 between the flange and housing. Manifold cap 47 has a central opening 55 engaging over portion 53 and is in threaded engagement with external threads on the cylindrical portion of manifold 49.

The valve member 34 basically comprises a disc-shaped portion having a downwardly depending stem 54 which extends through orifice 26 and into passageway 23. Stem 54 has a transverse slit or bore 56 through which looped end 60 of a pull cable 58 extends. The pull cable 58 extends back through passageway 23 and out via inlet 16, through inflation hose 18 and into power inflator 40, as illustrated in FIG. 1. The looped opposite end 59 of the cable is secured in the power inflator in any suitable manner, for example as described in my co-pending application referred to above. Seal 46 is a flat annular member of elastomeric material which is seated in an annular groove 62 at the upper end of stem 54 so as to be trapped between valve member 34 and valve seat 38 when the valve is in the first, closed position as illustrated in FIG. 4.

The disc-shaped portion of the valve member 34 has an outer annular rim 64 on which an elongate opening or slot 66 is located. The slot 66 is designed for sliding engagement over a similarly shaped pivot pin or projection 68 projecting upwardly from the lower wall 28 of the chamber 24 adjacent orifice 26, as best illustrated in FIG. 3. Pivot pin 68 is located on the opposite side of orifice 26 to the inlet 16. Rim 64 has a series of spaced circular openings 70 for increased air flow through the vent chamber when the valve is open. Openings 72 are also provided in the lower wall 28 around orifice 26 venting to the exterior of the housing for further increasing air flow out of the vent chamber when the valve member is in the open position of FIG. 5. Spring 36 extends between cap 30 and the valve member 34 so as to bias the valve member into the closed position, sealing orifice 28 and preventing any flow of gas out of the compensator via the vent chamber. Water will fill the vent chamber when the valve is closed.

As best illustrated in FIGS. 2 and 3, the disc-shaped portion of the valve member overlying orifice 26 will be exposed to the pressure of gas in the buoyancy compensator. When the gas pressure is sufficient to overcome the biassing force of spring 36, which will be set at a suitable safety level, the spring will compress and the valve member will be urged axially outwardly in the valve chamber 24 away from orifice 26 into a second position as illustrated in dotted outline in FIG. 2, in which the orifice 26 is open to allow gas to flow outwardly via vent outlets 32,72.

Figure 5:
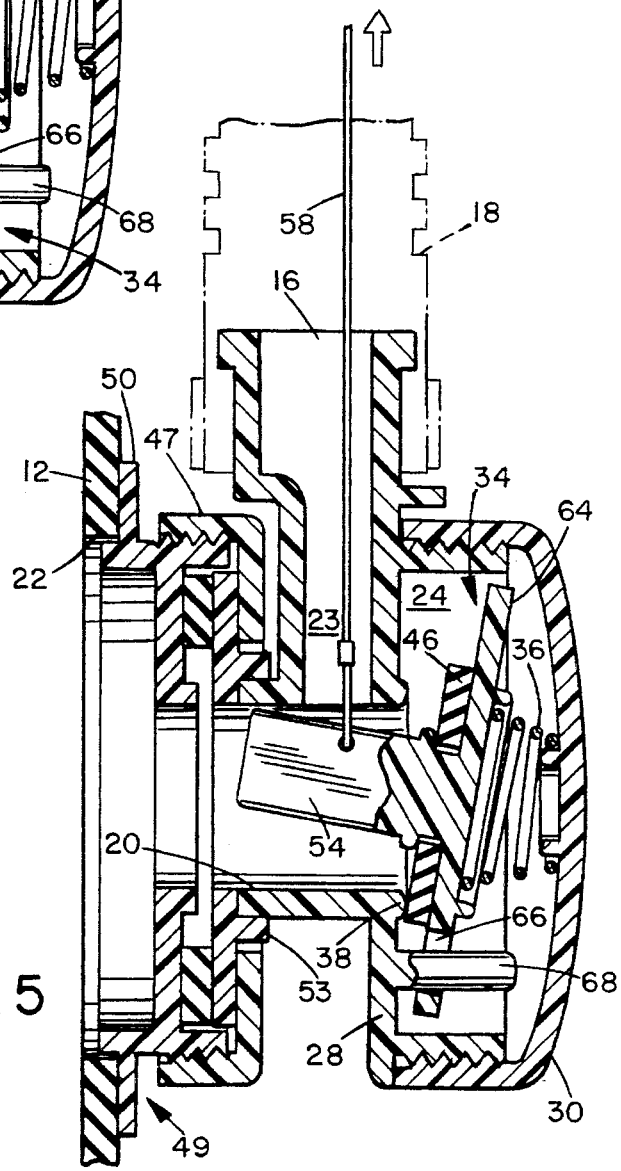
FIG. 5 is a view similar to FIG. 4, with the valve open.

The slot 66 is of larger cross-sectional dimensions than the pivot pin 68 over which it engages, and specifically has a greater width than pin 68. This permits the valve member to tilt or pivot about the axis of pin 68 between the first, closed position of FIGS. 2 and 3 and a third, tilted open position as illustrated in FIG. 5 in which the opposite side of the valve member to slot 66 tilts outwardly and away from orifice 26, again allowing gas flow outwardly via vent outlets 32 and 72. The valve member can be moved into the third, tilted position simply by pulling on cable 58, tilting stem sideways away from the pivot pin and simultaneously pivoting the disc-shaped portion of the valve member into the position illustrated in FIG. 5. The diver can therefore open the safety valve simply by reaching up and pulling down on the power inflator 40. The pull force on cable 58 in FIG. 5 will be directed transverse to pivot pin 68 and will produce the desired tilting movement to open the valve member.

This arrangement allows the pull cable to be connected directly to the valve stem, unlike prior art arrangements involving complex lever linkages, by pivotally mounting the valve disc itself so that it can be opened either by tilting or axial movement, avoiding the need to convert a pulling force directed transverse to the valve member into an axial movement of the valve member. This arrangement is simpler, less expensive, and less susceptible to failure than the relatively complex prior art arrangements.

Although a preferred embodiment of the invention has been described above by way of example only, it will be understood by those skilled in the field that modifications may be made to the disclosed embodiment without departing from the scope of the invention, which is defined by the appended claims.

I claim:

1. A safety valve for a buoyancy compensator, comprising:

a valve housing having an inlet for connection to one end of an expandable inflation hose, an outlet for connection to an air inlet of a buoyancy compensator, a connecting passageway between the inlet and the outlet, and a vent chamber with at least one vent outlet, the vent chamber having an orifice connecting the vent chamber with the connecting passageway for venting gas from the buoyancy compensator;

a valve seat in the vent chamber surrounding the orifice;

a valve member movably mounted in the vent chamber for movement between a first position closing the orifice and either of two different open positions in which the valve member is spaced from the orifice to allow gas to vent from the buoyancy compensator, the two different open positions comprising a second position in which the valve member is axially spaced from the orifice and a third position in which the valve member is tilted at an angle to the orifice;

biassing means for biassing the valve member towards the first, closed position;

a pivot mounting means in the vent chamber adjacent the valve seat for pivotally mounting the valve member on the valve seat for pivotal movement between the first and third positions, the pivot mounting means including slidably engaging means for slidably engaging the valve member to permit axial movement of the valve member between the first and second positions;

the valve member having a valve stem extending through said orifice into the passageway; and a pull cable having a first end connected to said valve stem and extending out of said housing through said inlet for passing through said inflation hose and connecting to a power inflator coupled to an opposite end of said inflation hose;

whereby the valve member can be moved manually between the first and third positions by pulling on the pull cable and is biassed between the first and second positions when the pressure of gas acting on the valve member through the orifice is sufficient to overcome the biassing force of said biassing means.

2. The valve as claimed in claim 1, wherein the valve member comprises a disc-shaped portion in said vent chamber positioned over said orifice, and said stem extends from the center of said disc-shaped portion through said orifice.

3. The valve as claimed in claim 1, wherein the disc-shaped portion of said valve member is of larger diameter than said orifice and has an annular rim portion outside the periphery of said orifice, said rim portion having a plurality of spaced openings around its periphery.

4. The valve as claimed in claim 1, wherein the vent chamber has a lower wall in which said orifice is located, and a pivot pin projecting into said chamber from said lower wall adjacent said valve seat, said valve member having a pivot opening for slidable engagement over said pivot pin with some free play for permitting pivoting of said valve member about said pivot pin, said pivot pin and pivot opening comprising said pivot mounting means.

5. The valve as claimed in claim 4, wherein the pivot opening comprises an elongate slot extending in a direction which is substantially tangential to said orifice and transverse to said pull cable, and said pivot pin has a corresponding elongate cross-section of smaller dimensions than said slot.

6. The valve as claimed in claim 5, wherein said stem has a transverse bore, said pull cable extending through said bore for securing to said stem.

7. The valve as claimed in claim 4, wherein said vent chamber is co-axial with said outlet and said passageway has a portion extending radially relative to said vent chamber up to said inlet.

8. The valve as claimed in claim 7, wherein said valve member includes a substantially flat, disc-shaped portion in said vent chamber and said stem is of smaller diameter than said disc-shaped portion and said orifice and extends from said disc-shaped portion through said orifice towards said outlet.

9. A safety valve for a buoyancy compensator, comprising:

a valve housing having an inlet for connection to one end of an inflation hose for supplying gas to a buoyancy compensator, an outlet for connection to a gas inlet of a buoyancy compensator, and a passageway connecting the inlet to the outlet;

the housing having a vent chamber having at least one vent outlet for venting gas from the housing, and an orifice connecting the vent chamber to the passageway;

a valve member movably mounted in the chamber for movement between a first position closing said orifice and either one of two possible open positions spaced from said orifice to allow gas to vent from the buoyancy compensator;

a pivot pin in said chamber adjacent said orifice; and said valve member having a pivot opening of larger cross-sectional dimensions than said pivot pin for sliding, pivotal engagement over said pivot pin, and a stem projecting through said orifice for connection to a pull cable for manual actuation of said valve member;

whereby said valve member can move axially back and forth between said first position and a second position axially spaced from said orifice by sliding of said opening over said pivot pin, and can be pivoted from said first position into a third position pivoted about said pivot pin and away from said orifice by pulling said stem.

10. A buoyancy compensator assembly, comprising:

an inflatable buoyancy compensator bladder having a fill inlet for gas supply to and from the bladder;

a safety valve housing coupled to said fill inlet, the housing having an outlet connected to said fill inlet, an inlet, a passageway extending from said inlet to said outlet, and a vent chamber having an orifice communicating with said passageway, a valve member pivotally mounted in said vent chamber over said orifice for pivotal movement between a first position closing said orifice and a second position pivoted at an angle to said orifice to allow gas flow through said orifice, and at least one vent outlet;

an inflation hose having a first end secured to the inlet of said valve housing and a second end;

a power inflator carried on the second end of the inflation hose for manual control of gas pressure in the bladder; and a pull cable extending through the inflation hose and having a first end coupled directly to the valve member and a second end connected to said power inflator, whereby said valve member can be pivoted between said first and second positions by pulling said pull cable via said power inflator.

* * * * *